United States Patent [19]

Hawthorne et al.

[11] 4,021,076

[45] May 3, 1977

[54] WIRE COMMUNICATIONS CHANNEL FOR A PAIR OF UNITIZED AUGERS

[75] Inventors: Arthur L. Hawthorne, St. Clairsville, Ohio; David R. Hazen, McMurray, Pa.

[73] Assignee: Consolidation Coal Company, Ponca City, Okla.

[22] Filed: May 2, 1975

[21] Appl. No.: 574,186

[52] U.S. Cl. ..... 299/56; 175/61; 299/30

[51] Int. Cl.[2] ..... E21C 27/22

[58] Field of Search ..... 299/55, 56, 1, 30; 175/24, 40, 107, 323; 198/213, 36, 9

[56] References Cited

UNITED STATES PATENTS

| | | | |
|---|---|---|---|
| 1,564,926 | 12/1925 | Armstrong et al. | 198/213 |
| 2,715,526 | 8/1955 | Letts | 175/76 X |
| 2,942,714 | 6/1960 | Glaser | 198/213 X |
| 3,036,821 | 5/1962 | Letts | 299/55 |
| 3,083,955 | 4/1963 | Compton | 299/56 |
| 3,746,110 | 7/1973 | Young et al. | 299/56 |
| 3,838,953 | 10/1974 | Peterson | 175/107 |
| 3,888,319 | 6/1975 | Bourne et al. | 175/24 X |

*Primary Examiner*—Ernest R. Purser
*Assistant Examiner*—William F. Pate, III
*Attorney, Agent, or Firm*—William J. Miller

[57] ABSTRACT

A pair of side-by-side augers, each having a shaft, a mateable rotational coupling on each end of the shaft, and flights along the shaft, are unitized by journaling bearings on each end of the shaft with spacers pivotally attached between each of the bearings on the same end of the shaft in order to align the axis of the shafts substantially parallel with each other. A longitudinal support member is rigidly secured between the spacers and between each of the flightings. A communications channel is provided in such a unitized auger assembly by mounting a channel along the top of the longitudinal support member. Apparatus is provided for inserting and removing the cable from the channel.

6 Claims, 7 Drawing Figures

WIRE COMMUNICATIONS CHANNEL FOR A PAIR OF UNITIZED AUGERS

RELATED APPLICATIONS

An application titled "Apparatus for Unitizing a Pair of Augers" by Hawthorne and Hazen, Ser. No. 574,011, filed 5-2-75,and an application titled "Support System for a Unitized Pair of Augers" by Hawthorne and Hazen, Ser. No. 574,135, filed 5-2-75, are related to this application.

BRIEF DESCRIPTION OF THE PRIOR ART

One method for removing minerals, such as coal, from a horizontal seam is to utilize a pair of side-by-side cutting heads connected axially to a pair of augers which are used to convey the material, once cut, out of the hole. One or more pairs of augers may be utilized depending upon the depth of the hole. Each auger is powered by a machine which applies axial as well as rotational forces to the augers to both force the augers and the cutting heads into the seam being mined and to rotate the cutting heads breaking away the material wherein the augers will then convey the material from the hole. On occasions, in order to prevent the pair of augers from being forced apart, spacers have been applied, for example, after each three to four sets of augers to tie the auger pairs together. An invention described in the above-referenced related application titled "Apparatus for Unitizing a Pair of Augers" describes a method for coupling two auger pairs which are normally positioned in side-by-side relationship so that the auger pair can be handled as a single unit. The unitized pair has several advantages over the individual side-by-side augers. First, the unitized pair requires much less time to handle, either removing or inserting, during the mining operation. Second, each unitized auger pair requires only a single pin to join one pair with the preceding pair. The pin will always be facing upward, thereby providing an easy method for removal. The method for unitizing the auger pair also provides other advantages, such as a means for supporting the auger pair off the ground and a means for conveying electrical wires along the auger pair in order to control the direction of the drilling operation. The last-mentioned advantage is detailed herein.

BRIEF DESCRIPTION OF THE INVENTION

This invention describes a method for unitizing a pair of augers and utilizing the unitizing apparatus for providing a communications channel between the augering machine and the electrical sensing apparatus near the vicinity of the cutting head. The auger pairs are unitized by mounting bearings around each end of the individual augers. A spacing bar is pivotally mounted between the bearings and secured to the bearings. A longitudinal bar is connected between each of the spacing bars and rigidly attached to the spacing bars. The longitudinal bar provides the means for mounting a communications channel. A tubular member having a slot slightly wider than the diameter of the cable is attached to the top of the longitudinal member, with the slot facing upward or away from the longitudinal member. A wire can then be inserted into the slot by an apparatus, such as a roller when the augers are being forced into a longitudinal seam. The communications cable which has been attached to the electronic instrument located adjacent to cutting head can be unreeled from a storage reel and forced into the communications slot by a roller which is biased against the communications slot. If the augers are being removed, as they are gradually pulled out of the drilled hole, the reel will wind up the excess cable from the slot with the roller controlling the removal process of the cable from the communications channel. Since the longitudinal member remains stationary at all times, no provisions are necessary for providing brushes or electrical connectors or other systems which are inherently difficult to maintain.

These and other advantages will be apparent when the specification and claims are read in view of the accompanying drawings.

DETAILED DESCRIPTION OF THE INVENTION

Similar numbers will be used throughout this specification for similar elements.

Figure 1:
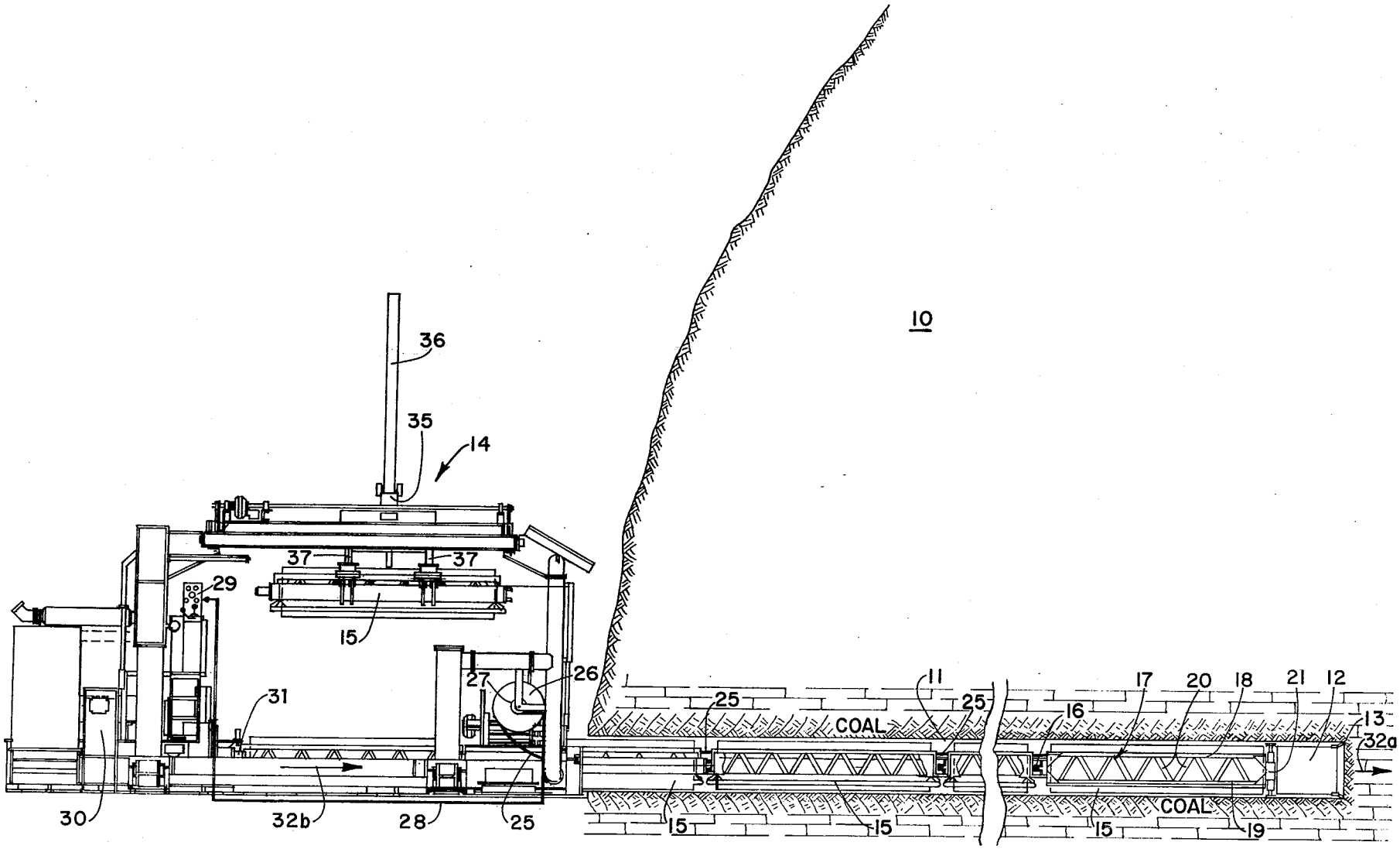
FIG. 1 is a cross-sectional view of the hillside illustrating the augering machine outside the hillside and several auger pairs inside the hillside during a mining operation.

Referring to FIG. 1, a hillside generally referred to by the number 10 has a mined-out portion 11 being cut by a pair of boring or cutter heads 12 having teeth 13. An augering machine generally referred to by the arrow 14 has a plurality of unitized auger sections 15 attached to its power output source. Each of the unitized sections illustrated in FIG. 1 has one auger conveyor removed in order to better illustrate the horizontal support system in more complete detail. The horizontal support system will be described specifically in subsequent figures.

A joining coupling 16 is attached to a spacer bar not shown in FIG. 1. The spacer bar is attached to a longitudinal member 17. Longitudinal member 17 may consist of a top channel 18 and a bottom channel 19 connected by a plurality of diagonal braces 20 to form a truss.

A directional control apparatus 21 is mounted between the last unitized section 15 and drilling cutter head 12 and may include jacking means, for example, to force the cutter head 12 upwardly or downwardly and may also include a sensing element, for example, to determine the center of the coal seam, the direction the hole is being drilled, and other pertinent information to the drilling of a long horizontal hole. The directional information and location of the drilling head in the coal seam do not form a part of this invention. However, if reference is made to U.S. Pat. No. 3,853,185 titled "Guidance System for a Horizontal Drilling Apparatus," an illustration of the electronic circuitry necessary to control a horizontal drilling apparatus is set out. The patent to Gaskell et al, U.S. Pat. No. 3,141,512, titled "Straight Borehole Drilling With Automatic Detecting and Correcting Means" discloses an apparatus for changing the direction of a horizontal drill. Neither of the above patents forms a part of this invention but is included for information and illustrative purposes only. The electrical connections to the directional control apparatus contained in the vicinity of cutter head 12 are coupled through wires 25 to a reel 26. Brushes 27 on reel 26 convey the information through wires 28 to a control system 29 on augering apparatus 14. Augering apparatus 14 generally includes a power source referred to by an arrow 30 which is coupled at 31 to the unitized auger sections. It is obvious, of course, that each of the individual augers is driven through a gear box to power source 30. It is also obvious that not only rotational force is developed to the drive system but also axial pressure is developed along the length of the unitized sections by power system 30. Thus, as cutter head 12 cuts into hillside 10 in the direction of arrow 32*a*, the unitized augers will move in the direction of arrow 32*b*.

Augering machine 14 also includes a crane apparatus 35 which has a hydraulic lift 36 for attaching through arms 37 to unitized auger section 15. In the ordinary course of operation, the crane or lift 35 will pick up a unitized section setting beside the auger machine, lift it up, and lower it into the machine bed. Such a machine is well known and is currently being manufactured by the Salem Tool Company located in Salem, Ohio, and is readily available.

Figures 2, 5, 5A, 5B:
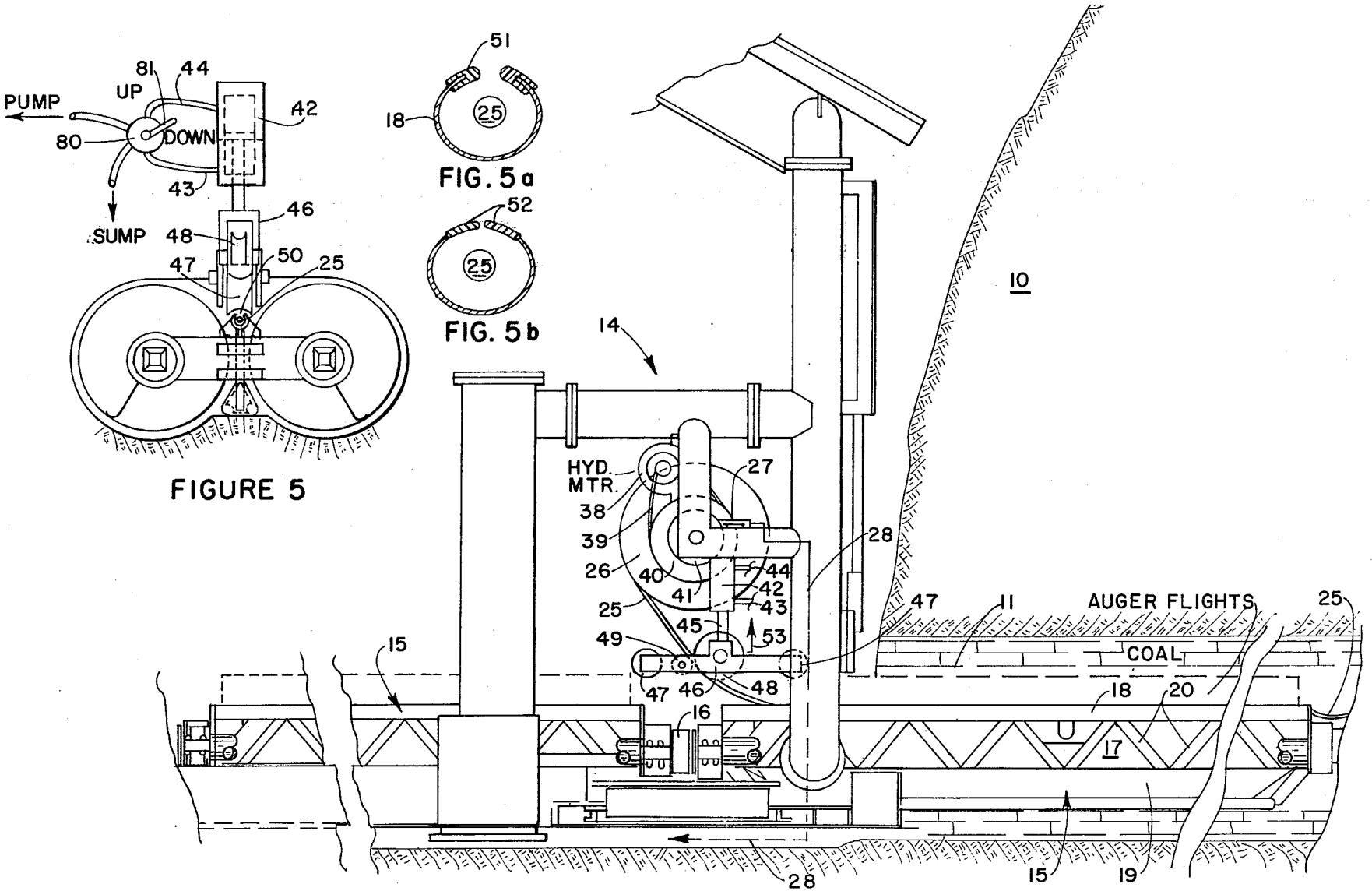
FIG. 2 is an enlarged portion of the drilling machine shown in FIG. 1 with the reel and associated wire cable insertion equipment in greater detail.
FIG. 5 is an end view of the apparatus illustrated in FIG. 3 with the hydraulic actuating cylinder illustrated.
FIGS. 5*a* and 5*b* are cross sections of the wire channel illustrating two other modifications.
Figure 3:
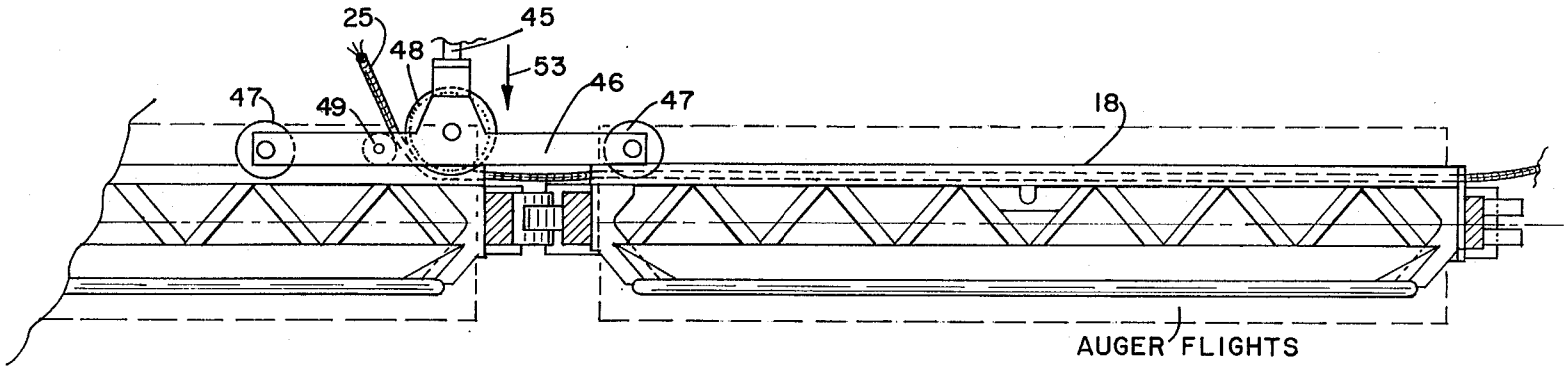
FIG. 3 is a side view of several unitized auger pairs with the auger on the viewing side removed to better illustrate the system in detail.

Referring to FIGS. 2, 3, 4, and 5, but in particular to FIGS. 2 and 3, reel 26 is driven by a hydraulic motor 38 which has a belt 39 coupled to a pulley 40. Slip rings 41 are connected to previously mentioned brushes 27 which are obviously connected to the terminus of cable 25.

A hydraulic cylinder 42 has a port 43 and a second port 44 utilized for lifting and lowering a piston inside cylinder 42 (not shown). Connected to the piston is a shaft 45 which is coupled to a T-shaped frame support member. Support member 46 has a pair of wheels 47 journaled at each end. Wheels 47 have a concave periphery in order to ride on a channel which will be later described. A wheel 48 is likewise journaled in T-shaped frame 46, and it likewise has a concave periphery. The concave periphery permits gripping the edge of the channel which will be later described and also permits guiding of cable 25. A fourth wheel 49 is mounted next to wheel 48 and prevents wire 25 from moving out of the concave periphery of wheel 48 when cable 25 is in the slack condition.

Figure 4:
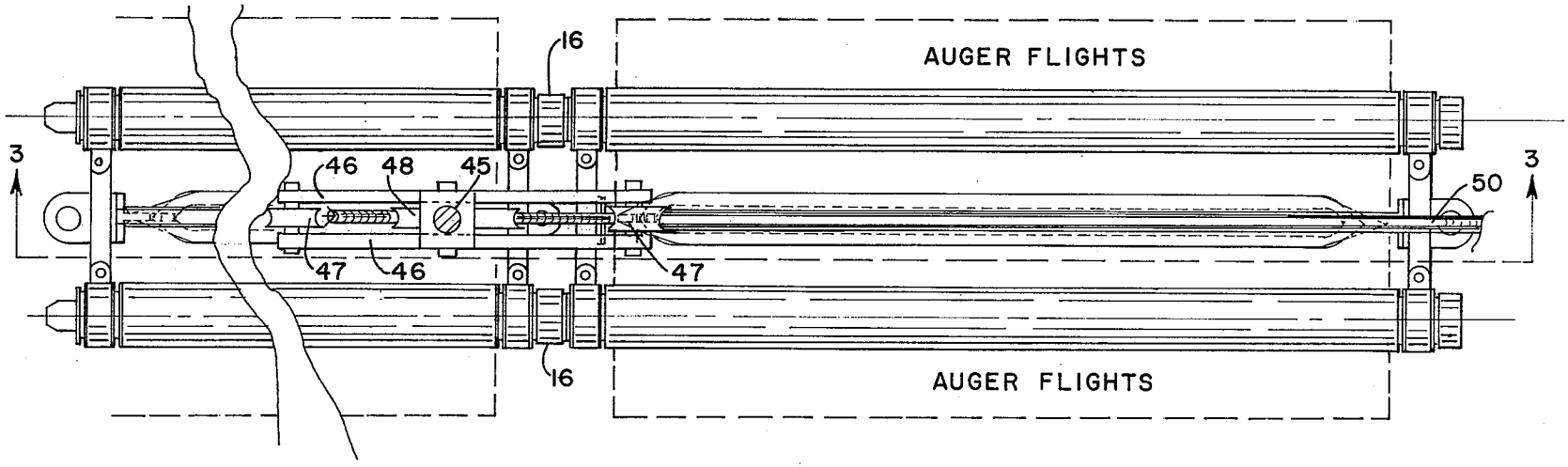
FIG. 4 is a top view of the apparatus illustrated in FIG. 3.

Referring in particular to FIGS. 3, 4, and 5, the channel 18 which carries the wire is a substantially C-shaped channel (see FIG. 5) having a slot 50 facing upwardly with the channel opposite the slot fastened to the longitudinal support member 17. Slot 50 has a width sufficient to permit entry of wire 25. It is preferable that slot 50 be dimensioned as close to the diameter of wire 25 as is practical so that wire 25 will tend to stay within channel 18 rather than lift out of channel 18 through slot 50 during use of the apparatus. It is obvious, of course, that various type retainers, such as rubber fingers or a rubber-lined edge, could be utilized to partially close slot 50 during operations. The rubber fingers or rubber-lined slot would permit insertion or removal of the wire but would tend to keep it within the slot during the use of the augering apparatus since it would normally require more force to force the wire by the rubber fingers or by the rubber-lined edge of slot 50 than the wire could develop once it was pressed into the slot. See for example FIGS. 5*a* and 5*b*. 5*a* illustrates a rubber-lined edge 51 which is inserted around channel 18. The wire under normal use would be forced by the rubber-lined edge and into channel 18. FIG. 5*a* illustrates fingers 52 which would be spaced periodically along the channel 18, thereby retaining wire 25 in channel 18.

The lifting apparatus as illustrated in FIG. 5 may have a control valve 80 with a lever 81 to control the function of control cylinder 42. The operation of the system is standard and well known.

OPERATION

Referring to all of the drawings, but in particular to FIGS. 1 and 3, wire 25 can be forced into the slot or removed from the slot by means of an apparatus comprising hydraulic piston 42 and shaft 45 to T-shaped frame 46 using wheels 47, 48, and 49. In FIG. 1, the T-shaped frame is shown raised in the upward direction as illustrated by arrow 53. This is normally the position that the T-shaped frame 46 will occupy when a new auger section 15 is being inserted into the bed of machine 14 or being removed from the bed of auger machine 14. Once the unitized section 15 for example has been inserted into the bed and coupled at 16 to the preceding unitized section 15, T-shaped frame 46 will be lowered as illustrated in FIG. 3 so that the wheels 47 and 48 will contact the channel 18. As augering sections 15 work their way into the seam, wheel 48 will roll wire 25 into slot 50 and consequently into channel 18. The wire 25 will in some instances be forced by a rubber-lined edge 51 as illustrated in 5*a* or by a plurality of space fingers 52 as illustrated in FIG. 5*b*. If for example the augering section is being removed, as each joint 16 approaches the position shown in FIG. 2, frame 46 will be lifted in the direction of arrow 53. Unit 15 can then be lowered in the direction of the arrow 53 shown in FIG. 3 and the augering sections continued to be removed. It should be noted at this point that wheels 47 and 48 are spaced so that they can span the distance between the two channels 18 across joint 16. This will prevent wheel 48 from being decoupled from slot 18.

Cylinder 42 can under usual conditions be mounted rigidly to the augering machine 14; however, under some conditions, if the auger units 15 should wander from side to side, cylinder 42 can obviously be mounted in a fairly flexible coupling. Therefore, as wheels 47 and 48 tend to follow channel 18, if cylinder 42 must move laterally to accommodate the movement of wheels 47 and 48, it can do so.

CONCLUSIONS

Only a single form of wire insertion means has been illustrated. It is obvious that any means can be used to force the wire into channel 18. The basic invention comprises not the means of inserting or removing the wire from channel 18 but the channel itself as a means of supporting a wire for easy connection to electronic circuitry at the cutter head. It is important that wire 25 be maintained in one continuous piece in order to prevent the necessity of attaching and detaching through couplings a plurality of wire or cable segments. These couplings tend to corrode, get dirty, and make the connections between the electrical control circuits at the cutter head and the sensing circuits at drill augering machine 14 unreliable. The system illustrated here provides a means for storing the wire and for easily inserting it and removing it from channel 18, thus providing a continuous cable from the electronic circuitry to the drilling machine control unit. The wire 25 may be as long as 1,000 feet; therefore, it is extremely important that couplings not be used on such a wire or cable length.

It is obvious that changes can be made in the apparatus disclosed herein and still be well within the teachings of the specification and appended claims.

What we claim is:

1. In a mining system having a plurality of pairs of augers rotatably joined by a spacing member at each end of said pairs of augers and a longitudinal member rigidly attached to said spacer members and wherein said system additionally includes an auger power unit coupled to the pairs of augers at one end and cutting heads coupled to the pairs of augers at the other end with remote sensing equipment mounted on the auger pairs near said cutting head, said system comprising:

a. a cable receiving means attached to said longitudinal member;

b. a cable having an outside diameter;

c. means for attaching said cable to said sensing equipment; and d. means for inserting and removing said cable into and out of said cable receiving means.

2. A system as described in claim 1 including reel means mounted on said auger power unit for storing said cable.

3. A system as described in claim 1 wherein said means for inserting and removing said cable into and out of said cable receiving means comprises a roller biased against said cable receiving means, said roller having an arcuately grooved periphery of a diameter equal to or greater than the outside diameter of said cable.

4. A system as described in claim 3 wherein said cable receiving means comprises a tubular member having a slot along its length, said slot having a width greater than the diameter of said cable and wherein the side of said tubular member opposite said slot is attached to said longitudinal member.

5. A slot as defined in claim 4 which has a flexible material along each side of said slot.

6. A slot as defined in claim 4 which has flexible fingers spaced along said slot and attached to the edges of said slot.

* * * * *